US005875860A

United States Patent [19]

Coelus

[11] Patent Number: 5,875,860

[45] Date of Patent: Mar. 2, 1999

[54] DRILL FOR MAKING A POLE IN THE GROUND AND A METHOD FOR APPLYING SUCH A DRILL

[75] Inventor: Gaspar Coelus, Astridlaan 53, 8450 Nieuwpoort, Belgium

[73] Assignees: Gaspar Coelus, Nieuwpoort; Frank Poorteman, Bazel, both of Belgium

[21] Appl. No.: 933,944

[22] Filed: Sep. 19, 1997

[30] Foreign Application Priority Data

Sep. 20, 1996 [BE] Belgium ..... 9600794

[51] Int. Cl.[6] ..... E21B 10/44

[52] U.S. Cl. ..... 175/323; 175/57; 175/325.5; 175/338; 175/391; 175/394

[58] Field of Search ..... 175/57, 323, 325.1, 175/325.5, 388, 391, 394

[56] References Cited

U.S. PATENT DOCUMENTS 4,402,371 9/1983 Rocchetti ..... 175/108
4,623,025 11/1986 Verstraeten ..... 175/394 X
4,790,689 12/1988 Henn et al. ..... 405/231 X

FOREIGN PATENT DOCUMENTS 0 010 037 A 4/1980 European Pat. Off. .
95/12050 5/1995 WIPO .

*Primary Examiner*—Roger Schoeppel
*Attorney, Agent, or Firm*—Bacon & Thomas, PLLC

[57] ABSTRACT

Drill for making a pole in the ground, whereby this drill (9) is provided with a passage (15) and whereby this drill has at the bottom a screw-shaped displacement part (11) of which the outside increases in radius upwardly, up to a diameter larger than that of the drill tube (8), characterized in that the displacement part (11) passes with its upper extremity into a cylindrical part (12) which is provided on its mantle with at least a screw blade (13) which runs in the shape of a screw in the same direction as the displacement part (11), but of which the pitch (S2) is larger than the pitch (S1) of the displacement part (11).

13 Claims, 5 Drawing Sheets

DRILL FOR MAKING A POLE IN THE GROUND AND A METHOD FOR APPLYING SUCH A DRILL

BACKGROUND OF THE INVENTION

1. Field of the Invention

This invention relates to a drill and a method for making a pole in the ground.

2. Description of the Related Art

Most building constructions which are built on ground with compressible upper layers are erected on foundation poles. The foundation poles penetrate through the compressible upper ground layers until deep enough into a sufficiently thick hard ground layer.

The resistance of the ground against the sinking of a pole with a certain diameter rapidly increases with the depth to which the pole has penetrated the good ground. The maximal resistance is reached at a depth in good ground of approximately four times the diameter of the pole.

On the basis of results of ground research and the load which must be supported by a pole, the most economic pole length and pole diameter can be determined.

However, this calculation is only reliable if the resistance of the fixed bearing-power in the ground layer is not reduced during the making of the pole.

This requirement is met in case of ram piles because the ground is displaced where the pole enters. However, the ramming causes vibrations in the ground and knocking sounds, both of which are a problem for the surroundings.

The problems increase as the poles' diameters increase and the poles have to be driven deeper into the hard ground. As a result, the maximal diameter of a pile is limited.

Especially for making poles with a relatively large diameter, first a hole is made in the ground by means of a drill and then during the removal of this drill a hardening material such as concrete is poured in the liberated space in the drill hole.

Especially two kinds of drills are used: screw drills and displacement drills.

A screw drill or auger consists of a thin drill tube which is provided along its entire length with a screw blade having constant pitch and diameter. The drill tube is closed at the bottom by a lost tip.

This screw drill is screwed in the ground while under a downward pressure. When the desired depth is reached, concrete is pumped in the drill tube while the screw drill is retracted from the ground, mostly without rotation. The lost tip remains in the ground. The concrete fills the hole under the screw drill.

During the drilling in of the screw drill, the surface of the screw blade which is in the ground increases. Since ground pressure also increases, the friction resistance against the drilling in by a penetration per revolution equal to the pitch increases by the square of the depth. The continuous screw blade rapidly becomes unable to penetrate the ground by the pitch per revolution. As a result, a crevice develops between the top of the ground above a winding of the screw blade and the bottom of the winding above it.

This crevice, which extends in the shape of a screw along the entire drilling depth, is filled with air under atmospheric pressure. This causes the surrounding ground to be eased during the drilling in, thus decreasing the resistance against the penetration of the screw drill in the ground. However, this is very detrimental to the bearing-power of the pole.

After the screw drill is removed from the ground, the ground material which remains between the windings of the screw blade is removed. This material needs to be carried off, which is also a problem.

Displacement drills allow making the drill hole without removing ground material. Such drills contain a hollow tube which is closed at the bottom by a lost tip. The hollow tube is surrounded by a drill head which thickens in the shape of a spiral upwardly and subsequently narrows in the shape of a spiral. The drill head is moreover provided on the broadest part with a screw blade.

During the drilling into the ground, the drilling machine exerts a downward pressure on the drill tube. The drill blade also exerts a downward pressure on the drill if the penetration per revolution is smaller than the pitch of the drill blade.

The bottom of the drill head then assures a sideways displacement of the ground and, at least in compressible ground, the drill sinks per revolution by little less or even more than the pitch of the screw blade. The compressed ground then forms a casing which temporarily protects the drill hole from collapse.

In solid, difficult to compress ground, however, an empty space can develop at the bottom of the screw blade, since the sinking per revolution is considerably smaller than the pitch of the screw blade. At this empty space the ground is eased and the bearing-power of the pole is decreased.

During the screwing out, the lost tip remains in the ground and concrete is poured through the drill tube and the drill into the space being liberated under the drill. The ground which has fallen around the drill tube and the ground which has been brought by the screw blade from under the drill to this place around the drill head is again displaced by the upper part of the drill head.

Thereby it is possible that in solid ground the drill only moves up much less than the pitch of the screw blade per revolution so that a volume of ground is transported down.

This ground is then pushed in the poured concrete so that the effective diameter of the pole decreases and hence its bearing-power decreases.

This last disadvantage is even more dangerous since it occurs imperceptibly and no inspection is possible in this respect.

SUMMARY OF THE INVENTION

The present invention aims at a drill for making a pole in the ground which does not present the above-mentioned disadvantages and which can have a large bearing-power for a given diameter and which makes easing of the ground impossible both during the drilling in and the drilling out, even with large diameters and/or in very heavy ground.

This aim is realized according to the invention by a drill which is provided with an axial passage, which is preferably closed at its bottom by a lost tip. At a bottom lead end this drill has a screw-shaped displacement part, the outside of which increases in diameter upwardly up to a diameter larger than that of the drill tube with which the drill is to be used. This displacement part passes with its upper extremity into a main cylindrical part which is provided on its mantle with at least one screw blade which runs in the shape of a screw in the same direction as the displacement part. The pitch of the screw blade is larger than the pitch of the displacement part.

The screw-shaped displacement part preferably extends over approximately one turn.

Also, the screw blade of the main cylindrical part preferably extends over approximately one turn.

On the main cylindrical part, several screw blades can be applied one above the other. The pitch thereof amounts to between approximately two times and approximately two and a half times the pitch of the displacement part.

The invention also relates to a method for making a pole in the ground whereby a drill according to the invention is drilled into the ground and drilled out again in the opposite direction of rotation. A hardening material is applied in the liberated space in the drill hole, possibly leaving the lost tip in the ground. The drilling in takes place at a speed whereby the downward movement of the drill per revolution is at least equal to the pitch of the displacement part. The drilling out takes place at a speed whereby the upward movement of the drill per revolution is approximately equal to the pitch of the screw blade on the main cylindrical part.

BRIEF DESCRIPTION OF THE DRAWINGS

In order to better show the characteristics of the invention, a preferred embodiment of a drill and a method for making a pole in the ground according to the invention are described hereafter, as an example without any limitative character whatsoever, reference being made to the accompanying drawings, in which.

DETAILED DESCRIPTION OF THE PREFERRED EMBODIMENT

Figure 1:
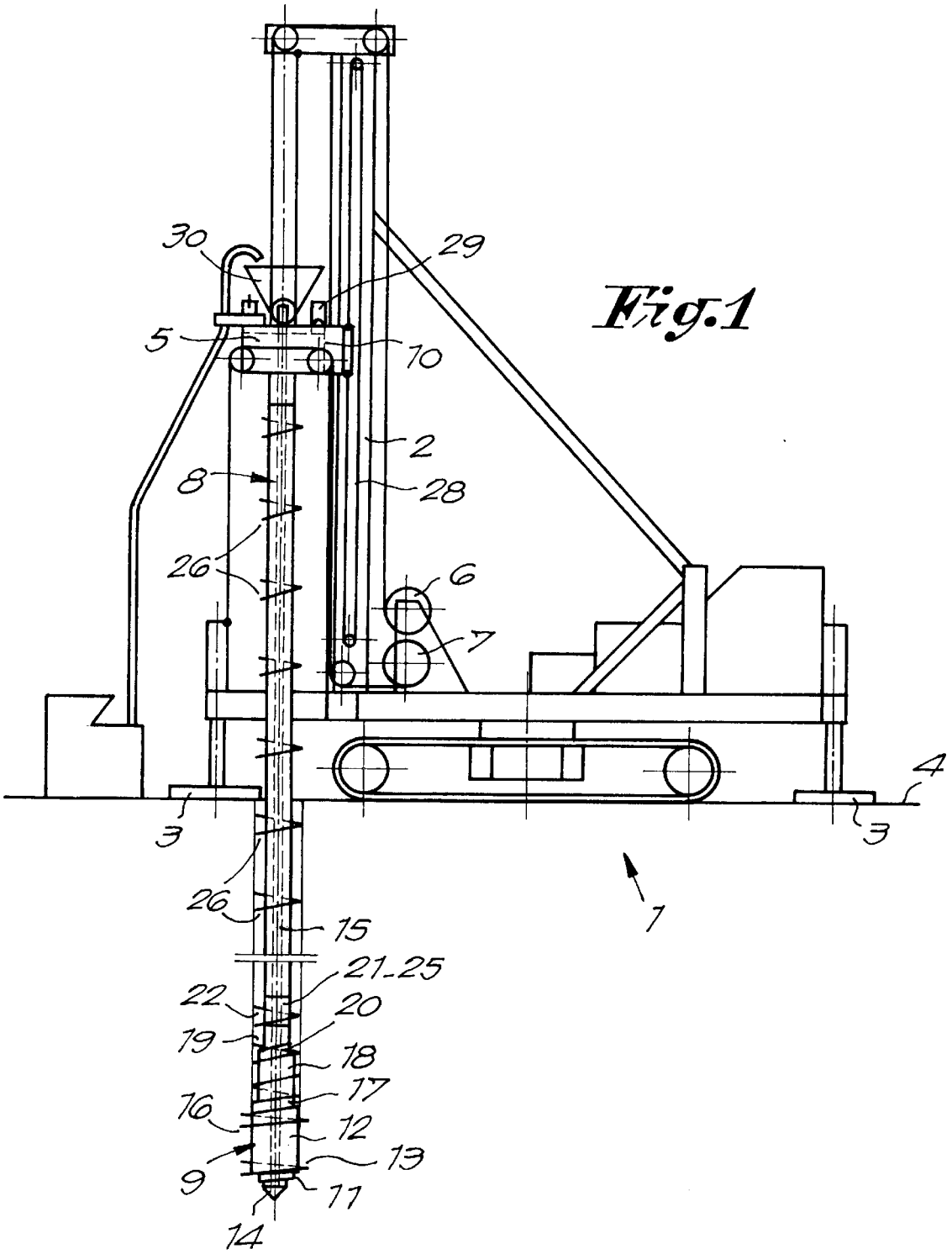
FIG. 1 schematically represents a side view of a complete drilling installation provided with a drill according to the invention.
Figure 2:
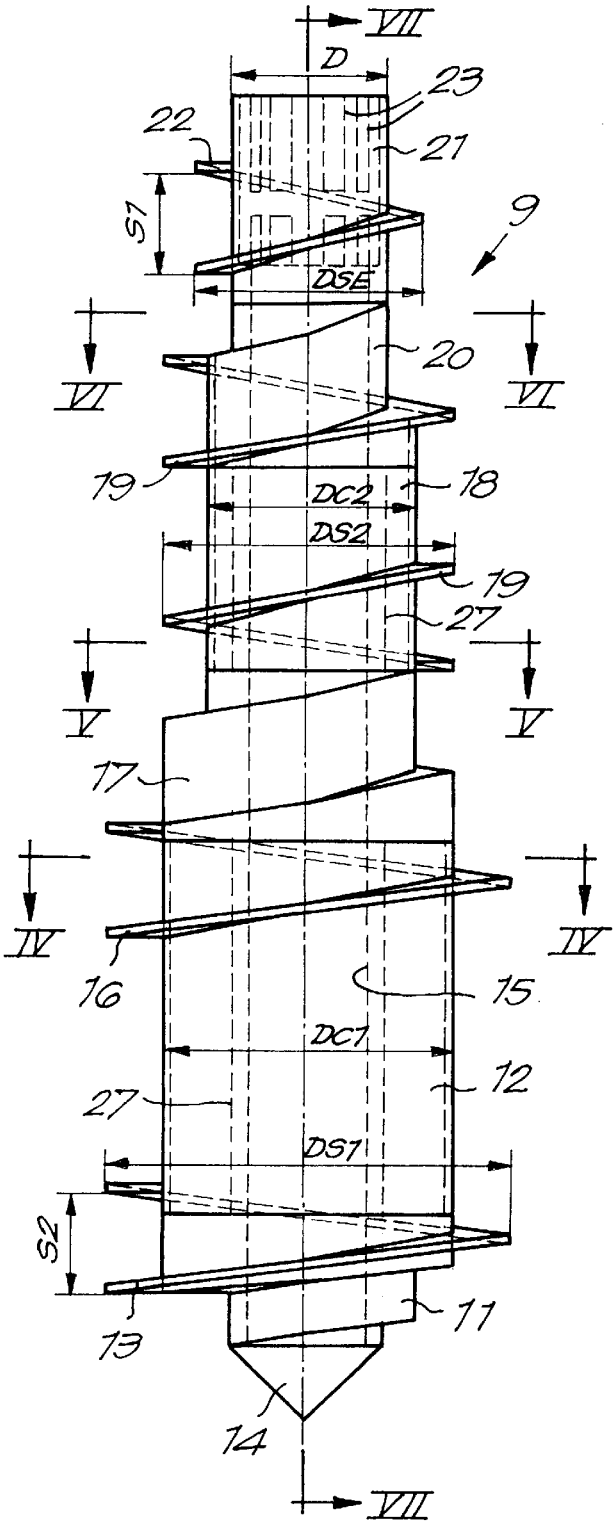
FIG. 2 represents at an enlarged scale a side view of the drill of the installation according to the invention of FIG. 2.
Figure 3:
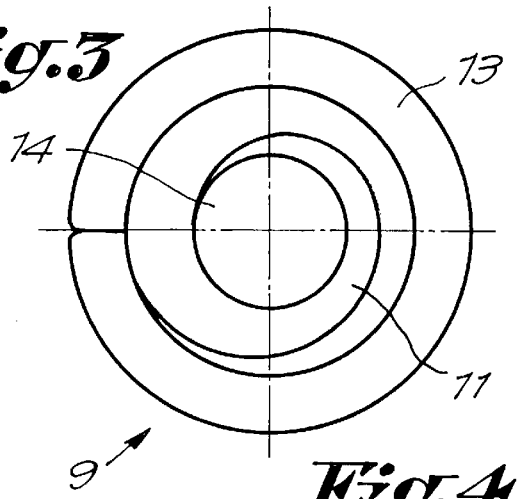
FIG. 3 represents a bottom view of the drill of FIG. 2.
Figure 4:
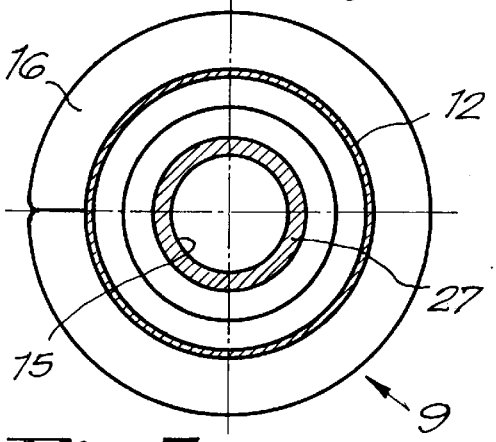
FIGS. 4, 5, 6 and 7 represent cross-sections according to lines IV—IV, V—V, VI—VI and VII—VII in FIG. 2, respectively.
Figure 5:
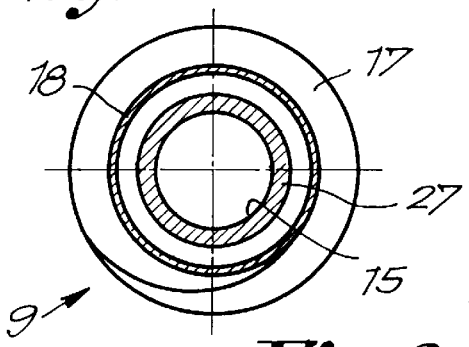
Figure 6:
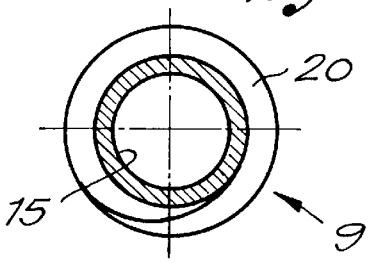
Figure 7:
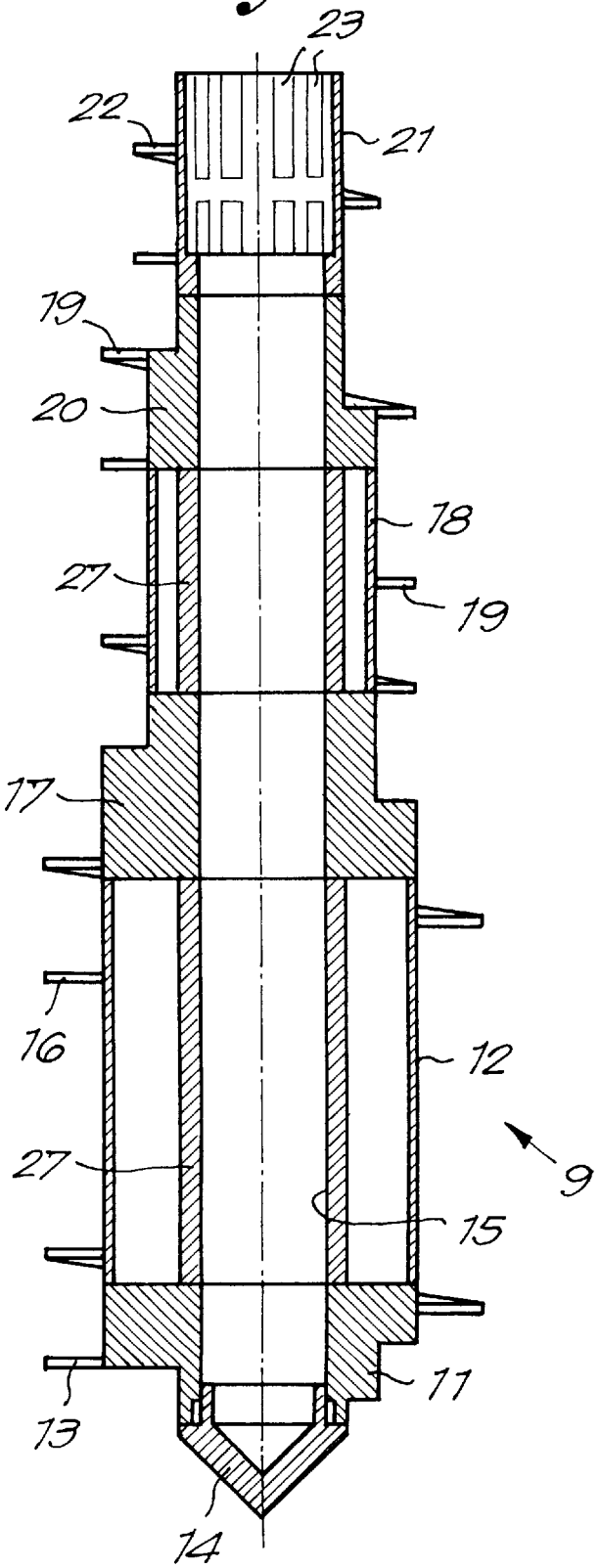

The drilling installation according to FIG. 1 comprises a movable chassis 1 with a mast 2 mounted thereon. The mast can be toppled down and is erected vertically during the drilling. During the drilling, the chassis can be stabilized on the ground surface 4 by means of supports 3, or can be anchored in the ground by means of anchors.

A drilling table 5 can slide over mast 2. On chassis 1 two winch mechanisms 6 and 7 are mounted, namely a winch mechanism 6 to pull drilling table 5 up and a winch mechanism 7 to push drilling table 5 down.

The drilling installation further comprises a cylindrical drill tube 8 which connects at its bottom to a top end of a drill 9. Drill tube 8 passes through a turning mechanism 10 which is mounted in or on drilling table 5. Drill tube 8 can be grasped by turning mechanism 10 to be rotated and/or moved up or down with drilling table 5.

According to the invention, drill 9 comprises a displacement part 11 having an outside radius which broadens in the shape of a spiral away from a bottom lead end of the drill, thus increasing in diameter. A main cylindrical part 12 is joined to displacement part 11 opposite the bottom lead end of the drill. Main cylindrical part 12 has a mantle which on a bottom extremity thereof is provided a screw blade 13. The pitch of screw blade 13 is larger than the pitch of displacement part 11.

Displacement part 11 extends over approximately one turn and connects at the bottom lead end to a lost tip 14 which temporarily closes an axial passage 15.

Screw blade 13 also extends over approximately one turn and starts where the upper extremity of the spiral-shaped outside radius of displacement part 11 joins the mantle of main cylindrical part 12. Screw blade 13 is bevelled in the shape of a spiral at its bottom.

The sense of rotation of screw blade 13 is the same as that of displacement part 11, but the pitch of screw blade 13 is much larger and preferably two to two and a half times the pitch of displacement part 11. Screw blade 13 has a constant outer diameter.

In the representative example, a second screw blade 16 is applied on cylindrical part 12 near the upper extremity thereof. Second screw blade 16 is directed in the same sense and has the same pitch and outer diameter as screw blade 13. It also extends over approximately one turn.

The diameter DS1 of screw blades 13 and 16 fulfills the following equation:

$$DS1^2=DC1^2\times S2/(S1-S2)$$

in which:

DC1 is the diameter of cylindrical part 12;

S1 is the pitch of displacement part 11;

S2 is the pitch of screw blade 13.

The length of main cylindrical part 12 is approximately equal to five times the diameter DC1.

The upper extremity of main cylindrical part 12 connects, by means of an upward spirally narrowing transition part 17 which thus has an outer wall of which the radius gradually decreases towards the top, to a second cylindrical part 18 with a smaller diameter DC2 which fulfills the following equation:

$$DC2^2=DC1^2\times(S2-S1)/S2$$

The pitch of transition part 17 is approximately equal to the pitch S2 of screw blade 13.

The length of second cylindrical part 18 is approximately equal to three times the diameter DC1 of cylindrical part 12.

One or more screw blades 19, in the representative example two screw blades, are mounted on second cylindrical part 18. Screw blades 19 extend over one turn in the same sense of rotation and with the same pitch as screw blades 13 and 16.

Screw blades 19 have a constant outer diameter DS2 which is approximately equal to the outer diameter DC1 of cylindrical part 12.

By means of a second upward spirally narrowing transition part 20 which thus has an outer wall of which the radius gradually decreases towards the top, the upper extremity of second cylindrical part 18 connects to a cylindrical end piece 21. The outer diameter of end piece 21 is approximately equal to the diameter D of drill tube 8. Second transition part 20 has the same pitch S2 as the screw blades 13, 16 and 19.

End piece 21 having a diameter D is provided on the outside with a screw blade 22 which extends over approximately one turn in the same sense and with the same pitch as screw blades 13, 16 and 19. Screw blade 22 has a constant outer diameter DSE which fulfills the equation:

$$DSE^2=D^2\times S2/(S2-S1)$$

End piece 21 is provided at its extremity with an internal relief which is formed for instance by ribs 23. The internal relief is complementary to a corresponding relief which is formed for instance by grooves 24 in the outside of a smaller diameter end part 25 of drill tube 8.

End piece 21 and end part 25 form two mutually fitting parts of a coupling by which drill tube 8 may thus be coupled to drill 9.

Figure 8:
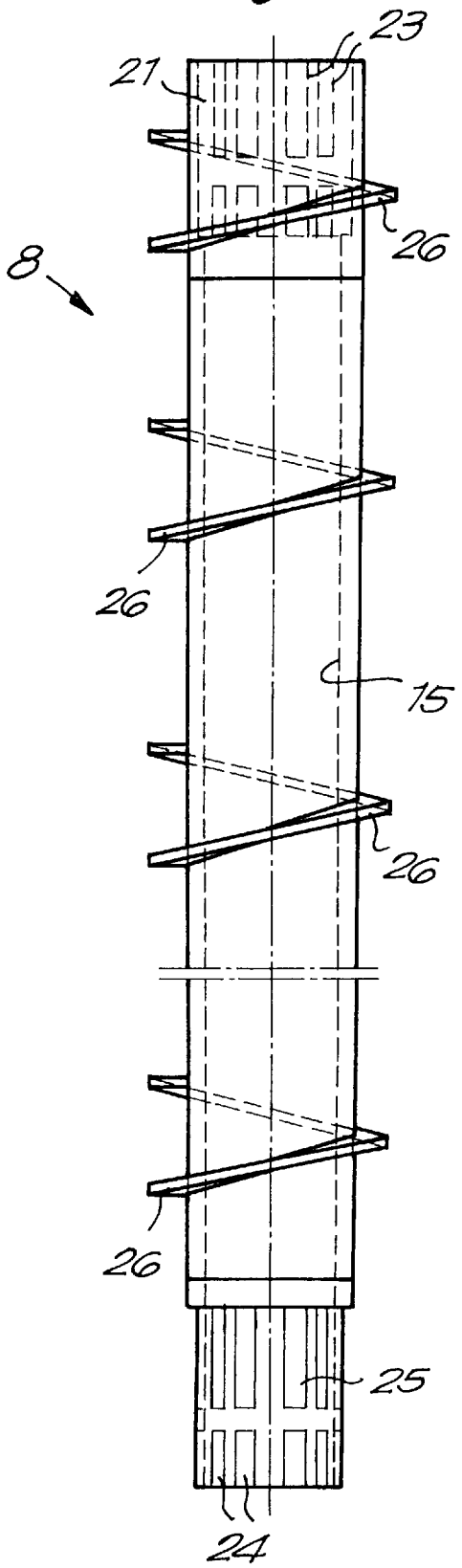
FIG. 8 represents a side view of a part of the drill tube from the installation of FIG. 1.

Drill tube 8 can itself consist of several parts which can be coupled to each other with such coupling parts. In FIG. 8 a bottom part of drill tube 8 is represented.

As represented in FIG. 8, each part of drill tube 8 is provided with several screw blades 26 which extend over one turn in the same sense and with the same pitch as screw blades 13 and 16. Screw blades 26 have a constant diameter which is approximately equal to the outer diameter of screw blade 22.

Figure 9:
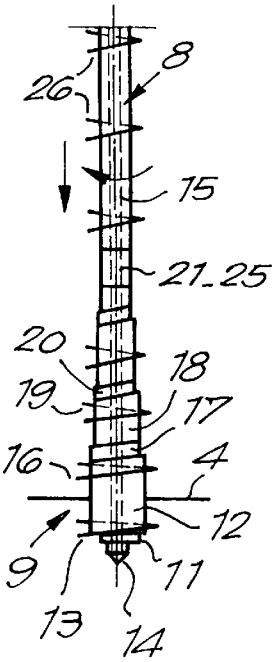
FIGS. 9 to 12 schematically represent the drill with the drill tube represented in consecutive phases during the application of the method according to the invention.
Figure 10:
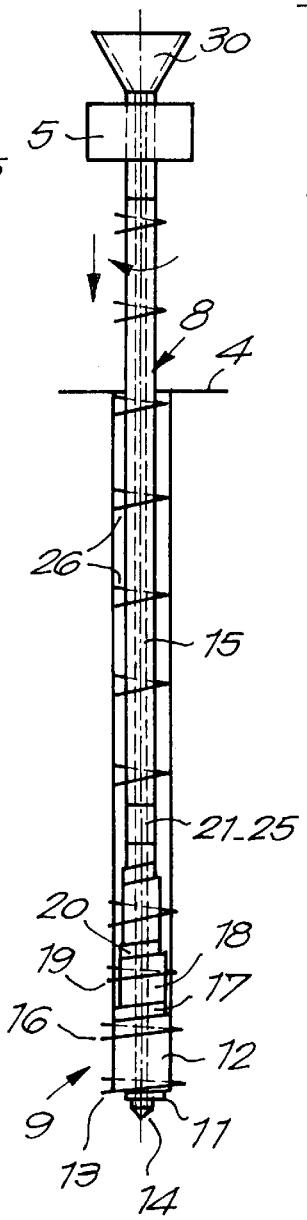
Figure 11:
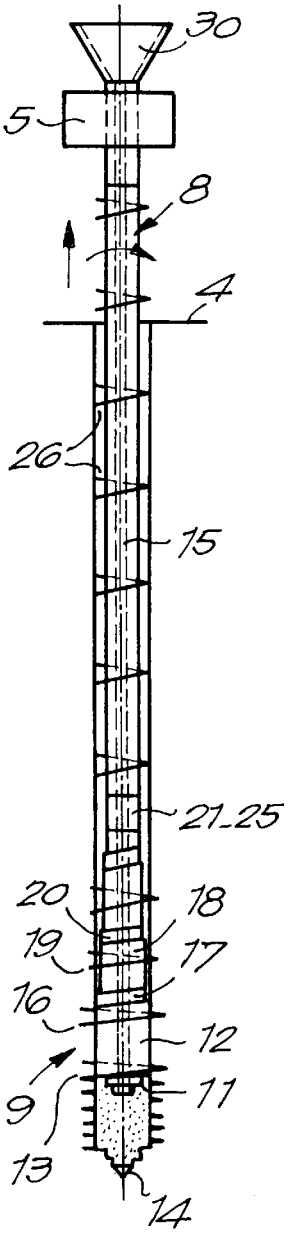

It is clear that between end piece 21 and second cylindrical part 18 one or more additional or subsequent cylindrical parts and transition parts may be applied, especially in case where poles of very large diameters are to be formed. For that matter, FIGS. 9, 10 and 11 schematically represent drill 9 with three cylindrical parts.

Subsequent cylindrical parts have a diameter DCX which fulfills the following equation:

$$DCX^2=(DCX-1)^2\times(S1-S2)/S2,$$

wherein DCX−1 is the diameter of the cylindrical part below it.

The diameter of the screw blade on a subsequent cylindrical part is each time approximately equal to the diameter DCX−1 of the cylindrical part below it.

Displacement part 11 and transition parts 17 and 20 are solid around axial passage 15. Cylindrical parts 12 and 18 are hollow and have an internal tube part 27 which forms axial passage 15 within these parts.

Axial passage 15 has approximately the same diameter everywhere, which is large enough that concrete of another hardening material can be poured fast enough.

In the following table, some examples are given of the different values of diameter and pitch in cm with two and three (X=3) cylindrical parts, respectively:

| S1 | S2 | D | DC1 | DS1 | DC2 | | |
|---|---|---|---|---|---|---|---|
| | | | | | | DSE | |
| 10 | 20 | 27.3 | 41 | 58.0 | 29.0 | 38.6 | |
| 10 | 20 | 29.9 | 46 | 65.0 | 32.5 | 42.3 | |
| 10 | 20 | 29.9 | 51 | 72.0 | 36.0 | 42.3 | |
| 9 | 21 | 32.4 | 56 | 74.0 | 42.3 | 42.9 | |
| 9 | 21 | 32.4 | 61 | 80.7 | 46.1 | 42.9 | |
| 9 | 21 | 32.4 | 66 | 87.3 | 49.9 | 42.9 | |
| | | | | | | DCX | DSE |
| 8 | 22 | 36 | 71 | 89.0 | 56.6 | 45.2 | 45.1 |
| 8 | 22 | 36 | 76 | 95.3 | 60.6 | 48.4 | 45.1 |
| 8 | 22 | 36 | 81 | 101.5 | 64.6 | 51.5 | 45.1 |

In order to form a pole in the ground with the installation described above, the following method is used.

By means of a winch 7, drill table 5 is pushed down while drill tube 8, and thus also drill 9 coupled therewith, is rotated by drill table 5 in such a way that drill 9 is drilled into the ground.

This takes place at a rate of downward movement at least equal to the pitch S1 of displacement part 11 for each rotation or turn of drill 9.

By displacement part 11, a volume of ground V1 is displaced per turn, equal to $pi\times DC1^2\times S1/4$.

By screw blade 13, a volume of ground V2 is displaced, equal to $(DS1^2-DC1^2)\times A\times pi/4$, whereby A is the thickness of screw blade 13. V2 amounts to only 5 to 6% with respect to V1.

By screw blade 13, a volume of ground V3 is transported up per turn, equal to $(DS1^2-DC1^2)\times(S1-S2)\times pi/4$.

The dimensions of said diameters and pitches are adjusted in such a way that V3 approximately equals V1. As a result, no empty space will develop under screw blade 13, since the space under screw blade 13 is immediately filled with ground which was displaced by displacement part 11. Therefore, no easing of the ground can develop. The volume V2 must be purely compressed.

Only a small volume needs to be compressed, only enough to prevent an easing of the ground, thus requiring a minimal energy for the drilling in.

At first, one drills through the loose ground with a descent per turn of more than S1, in practice almost equal to the pitch S2 of screw blade 13, for instance over approximately 9 m, as represented in FIG. 9 which relates to the drilling with a drill with three cylindrical parts.

Due to the downward speed which is more than S1 per turn, screw blades 13 and 16 will transport less ground up, and more ground will be compressed. Thus a compressed cohesive ground mantle is formed around drill 9.

Subsequently, one drills through a transitory area and finally over a distance of at least 8 times the diameter of the pole to be formed under the loose ground, that is, up to for instance approximately 14 m in solid ground, as represented in FIG. 10. This still takes place at a descent speed higher than S1 per turn.

It may be necessary to anchor chassis 1 in the ground or to apply a counterweight on chassis 1.

In order to be certain that the drill descends in the solid ground with a descent speed of at least S1 per turn, the downward movement of drill table 5 is measured with a device 28 which is mounted on mast 2 and the number of revolutions of drill tube 8 is measured by a device 29 mounted on drill table 5. From these data measurements, a microprocessor can control winch 7 and the turning mechanism for drill head 5 in such a way that the above-mentioned requirement is met.

Due to the relatively large length of main cylindrical part 12, the ground which is transported up by screw blades 13 and 16 is brought to a place where the ground is relatively compressible so that the displacement is relatively easy later on.

After reaching the desired depth, the sense of rotation of drill table 5 is reversed and drill table 5 is pulled up by winch 6.

During this drilling out, concrete is poured in drill tube 8 through a funnel 30.

Due to the weight of the concrete, lost tip 14 remains in the ground, as represented in FIG. 11.

This drilling out takes place at a rise per turn of a distance which is almost equal to the pitch S2 of screw blades 13 and 16. This can also be adjusted by the microprocessor which controls among other things winch 6.

As a result, it is assured that no easing of the ground takes place during the drilling out and that no ground is pushed in the poured concrete.

Figure 12:
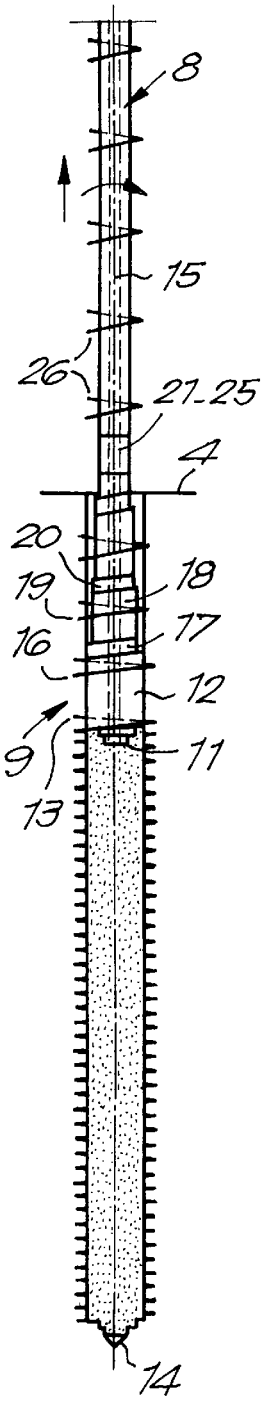

As represented in FIG. 12, a concrete pole is obtained with a diameter equal to the diameter DC1 of main cylindrical part 12, but with a concrete screw blade on it which corresponds with the screw-shaped groove made by screw blades 13 and 16.

In this way poles with a large diameter can be made in very hard ground such that the ground is guaranteed not to ease, so that the poles have a large bearing-power.

Figure 13:
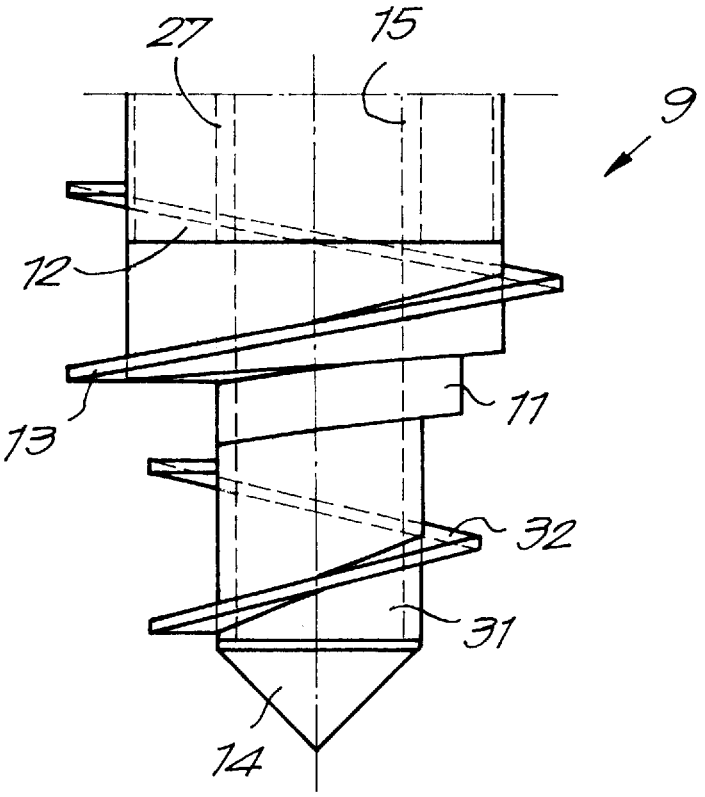
FIG. 13 represents a side view analogous to that of FIG. 2, but only of the bottom part of the drill and with respect to a different embodiment of the invention.

In FIG. 13, an embodiment of drill 8 is represented which is especially designed for the rarely occurring case where a very hard ground layer is present immediately below a loose ground layer.

In such a case, screw blades 13 and 16 can deliver practically no pulling power since they are located in loose ground.

For this reason, in this embodiment of drill 9, displacement part 11 is extended towards the bottom by an extension piece 31–32. Lost tip 14 connects to the bottom extremity of extension piece 31–32.

Extension piece 31–32 consists of a cylindrical body 31 through which axial passage 15 extends and a screw blade 32 mounted thereon. The outer diameter of cylindrical body 31 is approximately equal to the outer diameter of tube part 27. Screw blade 32 has the same sense of rotation and pitch as screw blades 13 and 16 but has a smaller outer diameter which is slightly larger than twice the largest radius of displacement part 11.

Screw blade 32 helps to pull displacement part 11 into the hard ground layer.

The present invention is in no way limited to the embodiments described above and represented in the drawings. Such a drill and method applying this drill can be realized in many variants without leaving the scope of the invention.

More specifically, the number of screw blades on cylindrical parts 12 and 18 need not necessarily be exactly two. One or more than two screw blades are possible. Also on end piece 21, zero or more than one screw blade can be applied.

These screw blades need not necessarily extend over exactly one turn.

I claim:

1. A drill for making a pole in the ground, comprising:

a top and a bottom lead end;

a screw-shaped displacement part at said bottom lead end, said displacement part having a pitch and having an outside radius which increases upwardly up to a diameter larger than an outer diameter of a drill tube with which said drill is to be used;

a main cylindrical part integrally disposed above said displacement part, said main cylindrical part having a mantle;

at least one screw blade disposed on said mantle, said screw blade having a larger pitch than the pitch of said displacement part and running in the shape of a screw in the same direction as said displacement part; and an axial passage through said displacement part and said main cylindrical part.

2. A drill according to claim 1, further comprising:

a lost tip attached to said displacement part such that said bottom lead end is closed.

3. A drill according to claim 1, wherein said screw-shaped displacement part extends over approximately one turn.

4. A drill according to claim 1, wherein said screw blade disposed on said mantle of said main cylindrical part extends over approximately one turn.

5. A drill according to claim 1, wherein said screw blade is located on a bottom extremity of said mantle of said main cylindrical part.

6. A drill according to claim 1, wherein said screw blade has a constant outer diameter.

7. A drill according to claim 1, wherein several approximately equal screw blades are disposed one above another on said mantle of said main cylindrical part.

8. A drill according to claim 1, further comprising:

at least one subsequent cylindrical part disposed above said main cylindrical part, said subsequent cylindrical part having a smaller radius than the cylindrical part located below it; and at least one upward spirally narrowing transition part which connects said subsequent cylindrical part to the cylindrical part located below it.

9. A drill according to claim 8, further comprising:

at least one subsequent screw blade disposed on said subsequent cylindrical part, said subsequent screw blade having an outer diameter approximately equal to the diameter of the cylindrical part located below it, said subsequent screw blade extending in the same direction and with the same pitch as said screw blade on said main cylindrical part.

10. A drill according to claim 8, further comprising:

an end piece located at said top and above the uppermost subsequent cylindrical part, said end piece having an outer diameter such that said end piece may be coupled to a drill tube with which said drill is to be used; and a subsequent upward spirally narrowing transition part which connects said end piece to the uppermost subsequent cylindrical part.

11. A drill according to claim 10, further comprising:

a drill tube coupled to said drill by said end piece; and additional screw blades disposed on said drill tube and said end piece, said additional screw blades extending in the same direction and having the same pitch as said screw blade on said main cylindrical part.

12. A drill according to claim 1, further comprising:

an extension piece having a cylindrical body, said extension piece extending downward from said displacement part; and an extension piece screw blade mounted on said cylindrical body of said extension piece.

13. A method for making a pole in the ground using a drill comprising a top and a bottom lead end; a screw-shaped displacement part at said bottom lead end, said displacement part having a pitch and having an outside radius which increases upwardly up to a diameter larger than an outer diameter of a drill tube with which said drill is to be used; a main cylindrical part integrally disposed above said displacement part, said main cylindrical part having a mantle; at least one screw blade disposed on said mantle, said screw blade having a larger pitch than the pitch of said displacement part and running in the shape of a screw in the same direction as said displacement part; and an axial passage through said displacement part and said main cylindrical part, comprising the steps of:

drilling said drill into the ground in a direction of rotation at a speed whereby downward movement of said drill per rotation of said drill is at least equal to said pitch of said displacement part;

drilling said drill out of the ground in an opposite direction of rotation at a speed whereby upward movement of said drill per rotation of said drill approximately equals said pitch of said screw blade on said main cylindrical part; and applying a hardening material through said axial passage in said drill into the liberated space of the drill hole.

* * * * *